US008367993B2

(12) United States Patent
Velez et al.

(10) Patent No.: US 8,367,993 B2
(45) Date of Patent: Feb. 5, 2013

(54) AERODYNAMIC FLIGHT TERMINATION SYSTEM AND METHOD

(75) Inventors: Javier Velez, Tucson, AZ (US); Ralph H. Klestadt, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 216 days.

(21) Appl. No.: 12/837,587

(22) Filed: Jul. 16, 2010

(65) Prior Publication Data

US 2012/0048993 A1 Mar. 1, 2012

(51) Int. Cl.
*F42B 15/01* (2006.01)

(52) U.S. Cl. ..... 244/3.28; 244/3.29; 244/3.27

(58) Field of Classification Search ..... 244/3.1, 244/3.21, 3.23, 3.24, 3.27, 3.28, 3.29; 102/495, 102/519, 490

See application file for complete search history.

(56) References Cited

U.S. PATENT DOCUMENTS

| | | | | |
|---|---|---|---|---|
| 3,964,696 | A | 6/1976 | Orzechowski et al. | |
| 4,054,254 | A * | 10/1977 | Cole | 244/3.21 |
| 5,379,968 | A * | 1/1995 | Grosso | 244/3.21 |
| 5,417,393 | A * | 5/1995 | Klestadt | 244/3.27 |
| 5,476,045 | A | 12/1995 | Chung et al. | |
| RE38,261 | E | 10/2003 | White | |
| 7,526,988 | B2 * | 5/2009 | Elder | 89/8 |
| 2004/0164202 | A1 * | 8/2004 | Klestadt et al. | 244/3.24 |

FOREIGN PATENT DOCUMENTS

DE 102008021932 A1 12/2008

OTHER PUBLICATIONS

International Search Report and Written Opinion from corresponding International Application No. PCT/US11/30667.

* cited by examiner

*Primary Examiner* — Christopher P Ellis
*Assistant Examiner* — Medhat Badawi
(74) *Attorney, Agent, or Firm* — Renner, Otto, Boisselle & Sklar, LLP

(57) ABSTRACT

A missile has a flight termination system that includes deployable lift surfaces that deploy forward of a center of gravity of the missile. When deployed, the lift surfaces cause the missile to rotate about its longitudinal axis. This rotation eventually increases in rate until the missile nears a natural roll frequency of the missile. As the missile nears or reaches its natural roll frequency, the missile's nose pitches up, angle of attack diverges and the missile tumbles, resulting in rapid termination of flight by loss of aerodynamic lift, vertical plunging and crashing. The lift surfaces may be curved surfaces that conform to the shape of a fuselage of the missile, prior to the deployment of the lift surfaces. The lift surfaces may be canted slightly relative to a missile longitudinal axis when the lift surfaces are deployed, so as to provide a sufficient rolling moment to overcome aerodynamic damping or resistance (roll drag) of the missile.

19 Claims, 6 Drawing Sheets

AERODYNAMIC FLIGHT TERMINATION SYSTEM AND METHOD

GOVERNMENT RIGHTS

This invention was made with United States Government Support under Contract Number W31P4Q-08-C-A789 with the Department of the Army. The United States Government has certain rights in this invention.

BACKGROUND OF THE INVENTION

1. Technical Field of the Invention

The invention is in the field of flight termination systems and methods for aircraft.

2. Description of the Related Art

There is a continuing need for flight termination systems, systems used in rapidly terminating the flight of guided missiles. One application for such systems is in preventing undesirable travel of missiles outside of test ranges or other physical spaces.

SUMMARY OF THE INVENTION

According to an aspect of the invention, a flight termination system and method involves deployable roll-producing surfaces that deploy from a missile fuselage, and are located forward of a center of gravity of the missile.

According to another aspect of the invention, a flight termination system and method involves inducing both a rolling rate and a destabilizing pitching moment.

According to yet another aspect of the invention, a method of missile flight termination includes deploying the roll-producing surfaces to cause a rolling attitude that approaches or reaches a rolling rate equal to the respective missile airframe natural frequency (or resonance rolling frequency), and in combination with a pitching-up attitude of the nose, cause total angle of attack divergence in a erratic fashion and ultimately aerodynamic tumbling.

According to a still further aspect of the invention, a flight termination system and method involves dynamic cross-coupling effects as a consequence of the rolling attitude at or near the natural frequency (or resonance) rolling rate.

According to still another aspect of the invention, a method of flight termination of a missile includes the steps of: deploying roll-producing lift surfaces from a fuselage of the missile, rolling the missile; and producing pitching-up moment while the missile is rolling. The rolling and pitching rates combine to produce unsteady oscillations in the pitch and yaw planes, leading to tumbling flight, assisted by the dynamic cross-coupling effects.

According to yet another aspect of the invention, a missile includes: a fuselage; and deployable roll-producing lift surfaces that deploy during flight from the fuselage, forward of a center of gravity of the missile. The lift surfaces provide a roll moment to the missile, as part of a flight termination system to terminate flight of the missile.

According to a further aspect of the invention, a method of terminating flight of a missile includes the steps of: rolling the missile; and pitching up the nose of the missile while the missile is rolling at a rolling rate. The rolling rate and pitching moment combine to produce aerodynamic tumbling of the missile.

According to a still further aspect of the invention, a method of flight termination or a missile includes the steps of: deploying roll-producing lift surfaces from a fuselage of the missile, wherein the flight termination system lift surfaces are forward of a center of gravity of the missile; and rolling the missile to substantially a missile natural resonance roll frequency of the missile, thereby causing oscillations in the pitch/yaw planes of the missile that cause pitching up of the nose of the missile and angle of attack divergence, leading to tumbling flight.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

DETAILED DESCRIPTION

A missile has a flight termination system that includes deployable lift surfaces that deploy forward of a center of gravity of the missile. When deployed, the lift surfaces cause the missile to rotate about its longitudinal axis. This rotation eventually increases in rate until the missile nears a natural roll frequency of the missile. As the missile nears or reaches its natural roll frequency, unsteady missile pitch/yaw angle divergence cause aerodynamic tumbling, resulting in rapid termination of flight by means of erratic loss of flight, vertical plunging and finally crashing of the missile. The lift surfaces may be curved surfaces that follow the shape of a fuselage of the missile, prior to the deployment of the lift surfaces. The lift surfaces may be canted slightly relative to a missile longitudinal axis when the lift surfaces are deployed, so as to provide a sufficient rolling moment to overcome aerodynamic damping (or air resistance to rolling) of the missile, and allow the missile's roll rate to reach the natural roll frequency in a suitable amount of time. The result is a non-explosive, inexpensive, and effective flight termination system.

Figure 1:
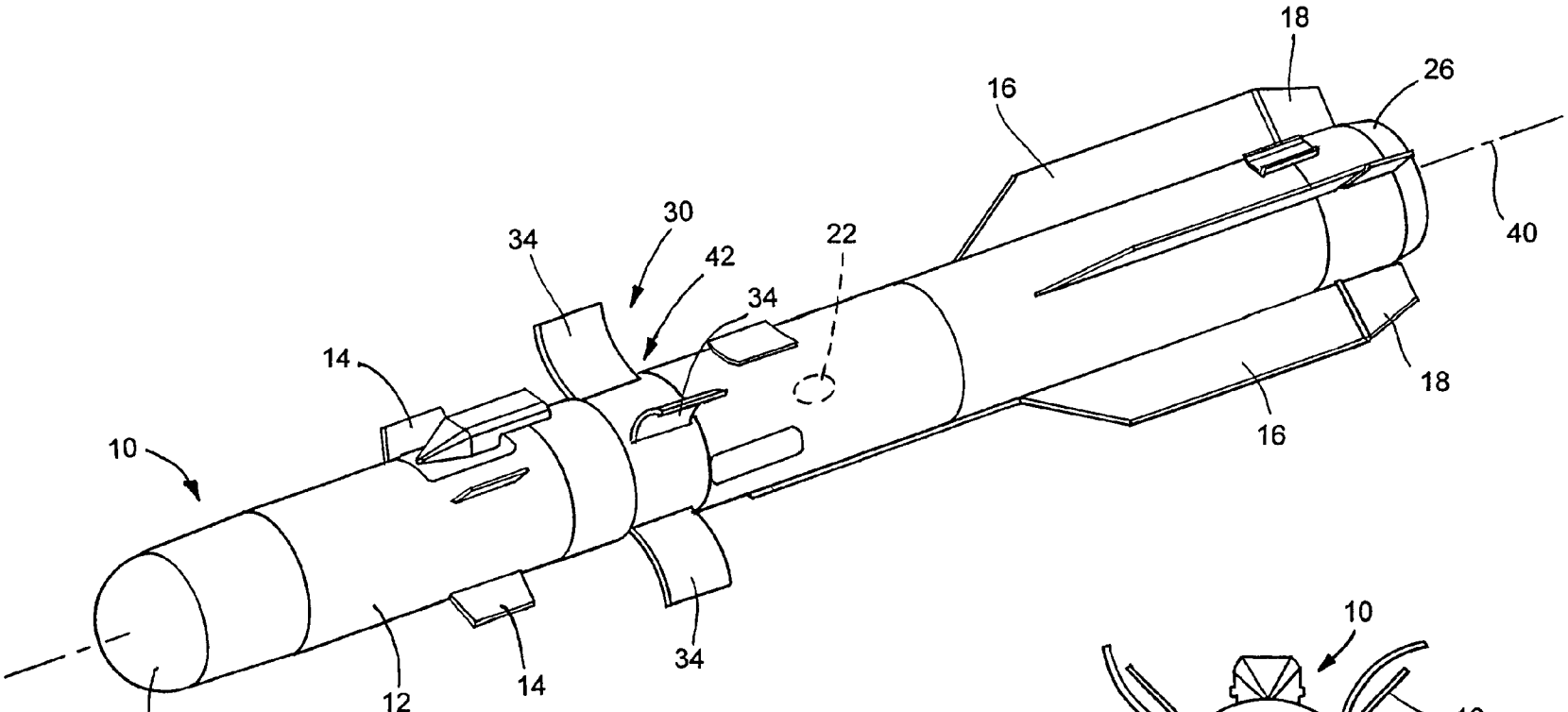
FIG. 1 is an oblique view of a missile that includes a flight termination system in accordance with the present invention.
Figure 2:
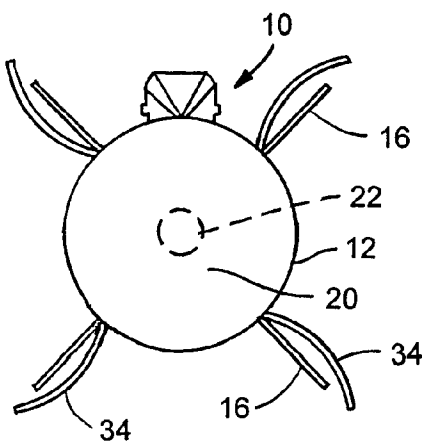
FIG. 2 is a front view of the missile of FIG. 1.

FIGS. 1 and 2 show a missile 10 that includes a fuselage 12, with canards 14 at the front of the fuselage 12, and with wings 16 and fins 18 toward the back of the fuselage 12. The canards 14 are between a nose 20 of the missile 10, and a missile center of gravity 22. The wings 16 and fins 18 may be located near an aft end 26 of the missile 10, aft of the center of gravity 22, where a propulsion system of the missile 10 may also be located. The propulsion system may include any of a variety of well-known means of propelling the missile, such as rocket engines (motors) or jet engines (motors).

The missile also includes a flight termination system 30 for selectively terminating flight of the missile 10. The flight termination system 30 may be activated to quickly terminate the missile's flight if the missile goes off course, or once missile testing is completed, such as in order to keep the missile 10 from leaving a test range or other physical space.

The flight termination system 30 includes a series of deployable roll-producing lift surfaces 34. The lift surfaces 34 are located forward of the missile center of gravity 22. The lift surfaces 34 are selectively deployed as a group, to produce a roll moment on the missile 10. As explained in greater detail below, the lift surfaces 34 cause the missile 10 to roll with increasing rate. As the missile reaches or approaches a missile natural roll frequency, it begins to wobble in its flight, and the nose 20 pitches up. This causes the missile 10 to tumble, resulting in rapid termination of flight.

In the illustrated embodiment there are four lift surfaces 34, although it will be appreciated that a greater or lesser number of lift surfaces may be employed. The lift surfaces 34 may be hingedly coupled to the fuselage 12, as in the illustrated embodiment. In addition the lift surfaces 34 may have a curved shape that conforms to the shape of the fuselage 12 in the stowed configuration, prior to deployment of the lift surfaces 34 into the airstream surrounding the fuselage 12. However it will be appreciated that other sorts of mechanical connections, deployment mechanisms, and/or lift surface shapes, may be employed.

The lift surfaces 34 may be held in place in their stowed condition, prior to deployment into the airstream, by any of a variety of suitable mechanisms. A variety of suitable mechanisms may be employed for deploying the lift surfaces 34. Certain examples of suitable mechanisms are given below, but it will be appreciated that the examples given are not intended to be limiting.

The lift surfaces 34 may be canted relative to a missile longitudinal axis 40 when the lift surfaces 34 are deployed. The canting of the lift surfaces 34 may be in a circumferential direction, providing an angle of attack for the lift surfaces 34 encountering airflow in a direction parallel to the longitudinal axis 40. The canting may provide an increase in the rolling (circumferential) moment created by the lift surfaces 34. Even without canting, however, it will be appreciated that lift surfaces 34 may provide sufficient lift to provide a rolling moment to roll or spin the missile 10. Toward that end, the lift surfaces 34 may have an airfoil shape that provides lift (force in a circumferential direction) even with a zero angle of attack.

The deployed roll-producing curved-panel angular deflection or relative free-stream flow incidence angle, if one exists, may be small, such as less than 1 degree; for example being in the range of 0.1 degree to 1 degree, or even more narrowly, such as in the range 0.2 to 0.3 degrees. Such a panel deflection may be sufficient to produce a roll moment from the combined effect of all four lift surfaces 34 to a desired amount. It may be desirable to reach the desired (or resonance) rolling rate faster by increasing the individual deflection of the lift surfaces 34, so as to induce a more aggressive missile 10 rolling attitude. However increasing the flight termination panel deflection too much may be undesirable in that the missile may accelerate its roll rate too quickly, resulting in the missile 10 passing through its natural roll frequency too fast, missing it, and not causing an effective flight termination. In addition, implementing an excessive destabilizing pitching moment may overshoot the total angle of attack too quickly, avoiding the gradual increase and settling of the missile 10 rolling rate towards resonance. Still, there may be a large range of destabilizing pitching moment magnitudes that will produce satisfactory performance. It will be appreciated that such aerodynamic variants may be determined by wind tunnel testing, and may be flown in a six-degrees-of-freedom (6-DOF) simulation to be validated.

The lift surfaces 34 may have any of a variety of suitable geometric characteristics towards the optimal efficiency of the flight termination system. These parametric variables may involve panel shape, size and aspect ratio.

The lift surfaces 34 may be made of any of a variety of suitable materials. Examples of suitable materials include steel, aluminum, titanium, or other suitable sheet metals.

Figure 3:
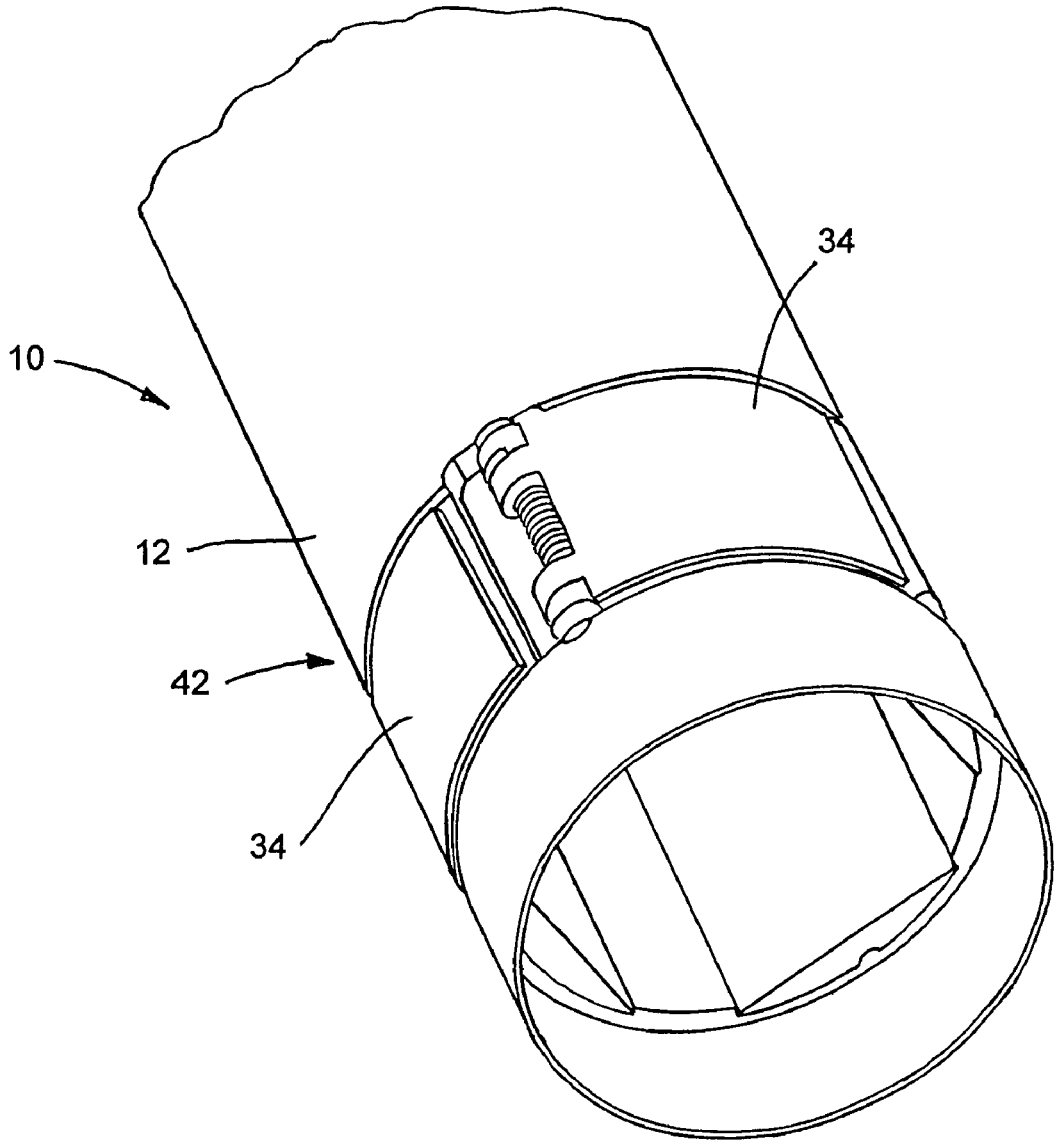
FIG. 3 is an oblique view of part of the missile of FIG. 1, with roll-producing lift surfaces of the flight termination system in a stowed configuration.
Figure 4:
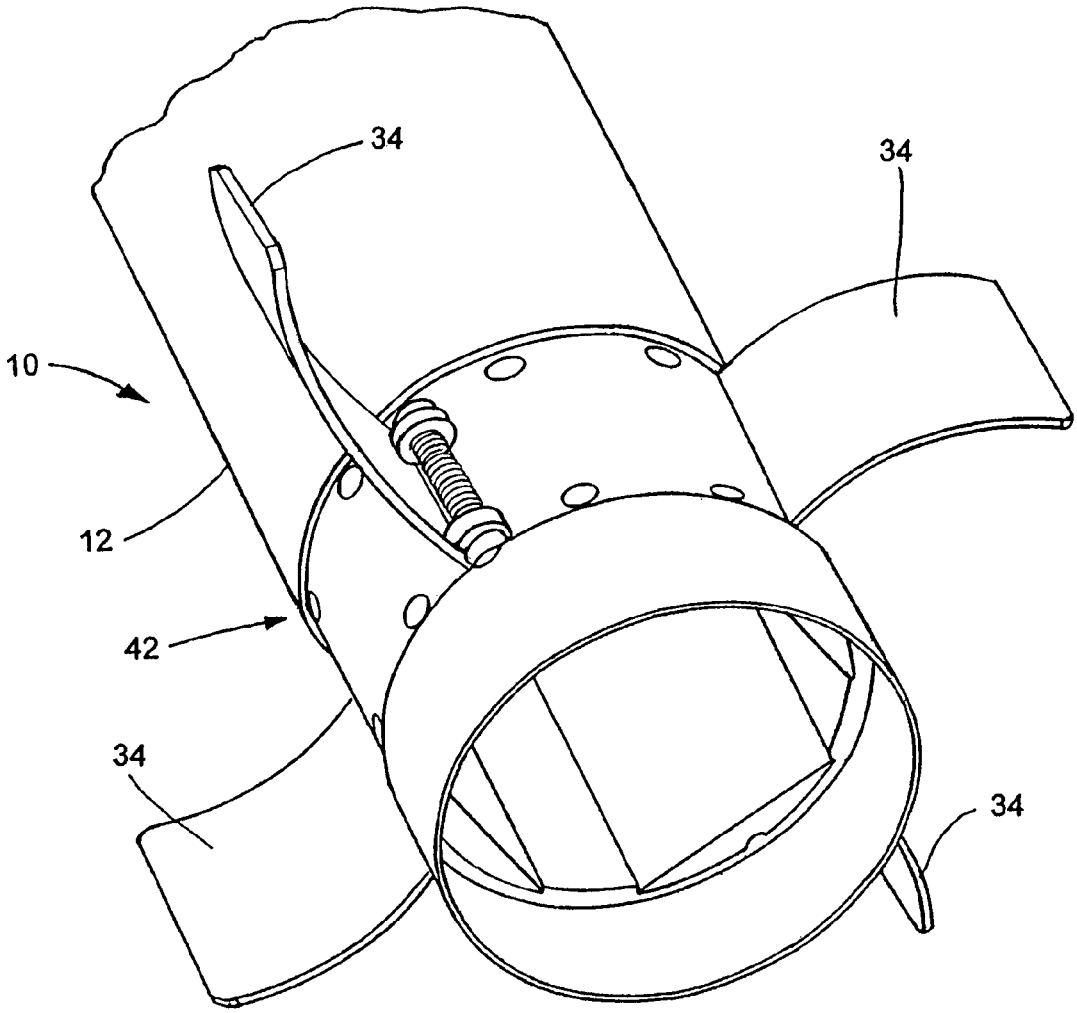
FIG. 4 is an oblique view of part of the missile of FIG. 1, with the lift surfaces of the flight termination system in a deployed configuration.

FIG. 3 shows the lift surfaces 34 in a stowed configuration, located in a recess 42 in the fuselage 12. FIG. 4 shows the lift surfaces 34 in a deployed configuration, with the lift surfaces 34 extending into the airstream surrounding the fuselage.

Figure 5:
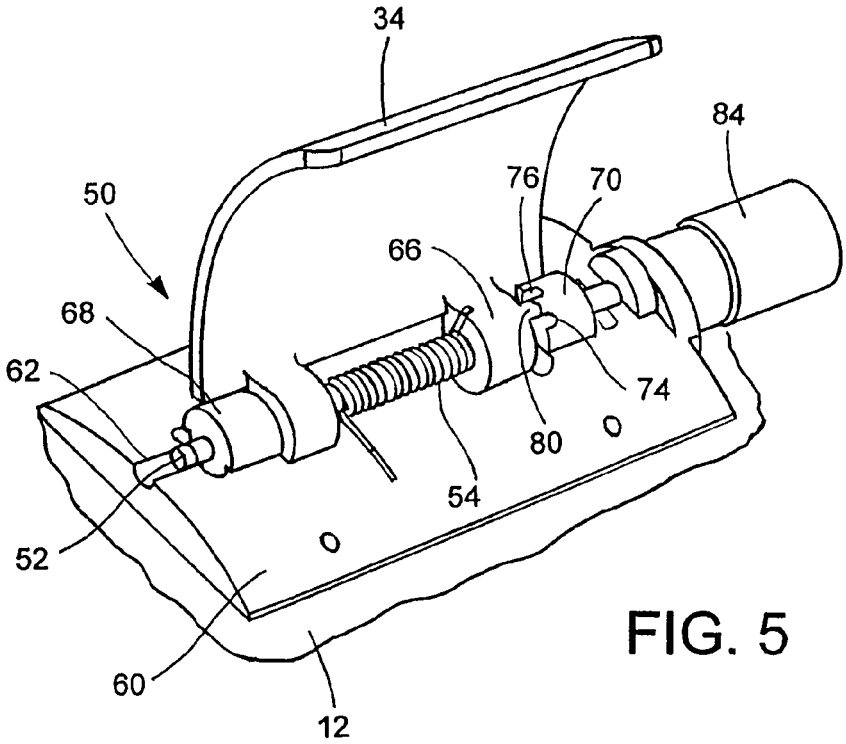
FIG. 5 is an oblique view showing some details of the connection between a fuselage of the missile, and one of the lift surfaces.
Figure 6:
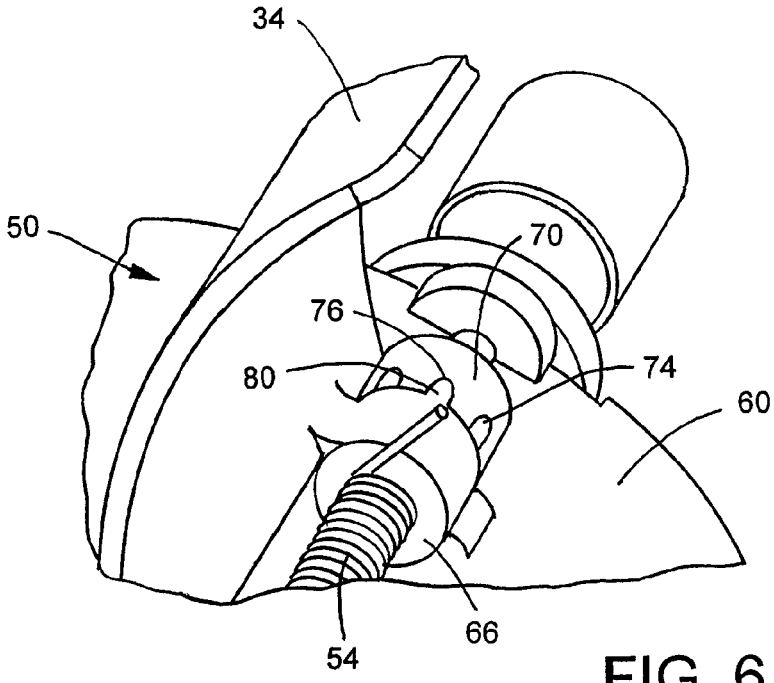
FIG. 6 is a detail view showing further details of the connection.
Figure 7:
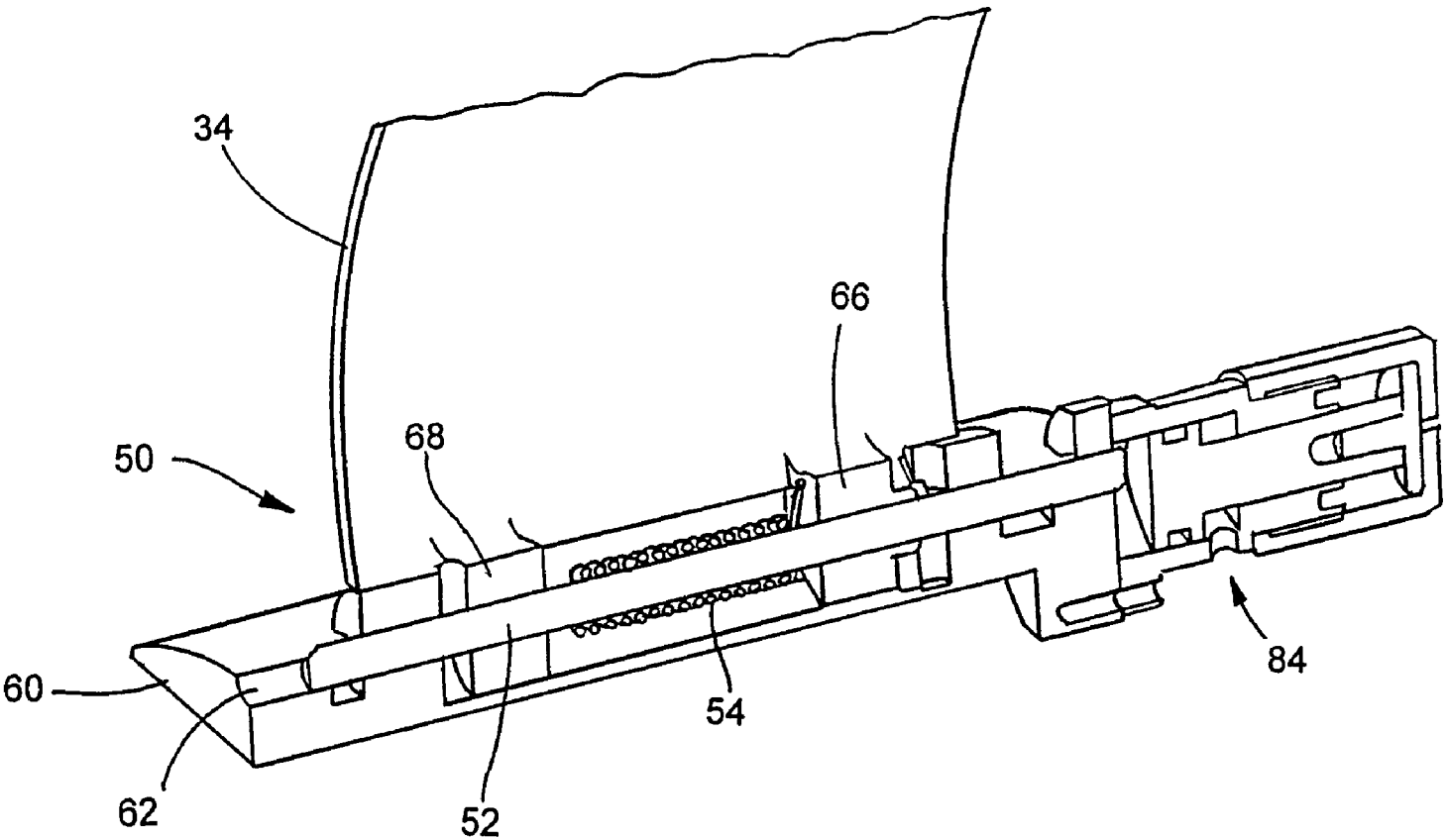
FIG. 7 is a cutaway view showing additional details of the connection.

FIGS. 5-7 show further details of a coupling mechanism 50 for hingedly coupling one of the lift surfaces 34 to the fuselage 12. The coupling mechanism includes a rod 52 with a spring 54 wrapped around it. The rod 52 fits into a recess 58 in a mounting plate 60 that is secured to the fuselage 12. One end of the spring 54 is fixedly attached to the mounting plate 60, in a groove 62 in the mounting plate 60. The other end of the spring 54 is fixed relative to the lift surface 34.

The mounting plate 60 has a protrusion 70 that also encircles or encloses the rod 52. The protrusion 70 is adjacent to the lift surface base part 66. The protrusion 70 has a pair of locking slots 74 and 76 for receiving a flange 80 extending off of one end of the base part 66. One of the slots (the slot 74) is used to hold the lift surface 34 in its stowed condition, prior to deployment. The other of the slots (the slot 76) is used to lock the lift surface 34 in its deployed condition. An axial pneumatic cylinder 84 is used to move the rod 52 axially (against a spring force from the spring 54), so as to temporarily disengage the flange 80 from the stowed lock slot 74 to allow deployment of the lift surface.

In operation the coupling mechanism 50 initially has the lift surface 34 held in place in the stowed configuration, with the flange 80 engaging the slot 74. The spring 54 is initially loaded both axially and torsionally. The axial loading of the spring 54 biases the base part 66 against the protrusion 70. This keeps flange 80 engaged with the slot 74, locking the lift surface 34 in the stowed condition until deployment of the lift surface 34 is desired.

The initial torsion loading of the spring 54 provides the torque that is used to deploy the lift surface 34 from its stowed condition. Deployment of the lift surface 34 is initiated by firing the pneumatic actuator 84. This moves the rod 52 and the lift surface 34 away from the pneumatic actuator 84. This movement causes the flange 80 to disengage from the slot 74, unlocking the lift surface 34. The spring 54 exerts a torque on the lift surface 34, rotating the lift surface 34 to deploy the lift surface 34. When the flange 80 reaches the deployed lock slot 76 the axial force of the spring 54 causes the flange 80 be pushed into the slot 76. This engagement between the flange 80 and the lock slot 76 locks the lift surface 34 into place in the deployed state.

The lift surfaces 34 will preferentially all be deployed at substantially the same time. To this effect, all of the pneumatic actuators 84 may be fired substantially simultaneously. The missile 10 may contain a radio or other receiver for receiving signals from a ground station (or other signal sender) to initiate operation of the flight termination system 30, to terminate missile flight. The missile 10 may contain a controller, for example including an integrated circuit and/or other suitable structures, to process incoming signals and control deployment of the lift surfaces 34.

The locking mechanism 50 shown in FIGS. 5-7 and described in the preceding paragraphs is only one example of many mechanisms for securing (locking) and selectively moving the lift surfaces 34. Many other mechanisms may be employed, applying any of a variety of suitable mechanical, electrical, hydraulic, and/or pneumatic mechanisms. Examples of such mechanisms include various combinations of springs, pins, gears, pulleys, and/or bearings, to list just a few of the many possible elements.

Figure 8:
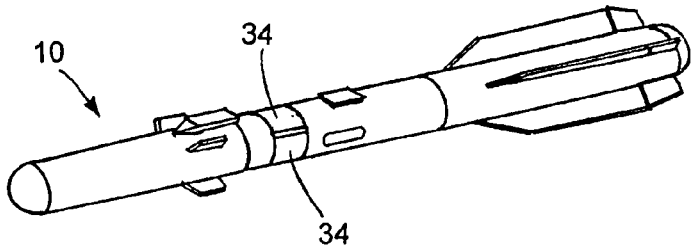
FIG. 8 is a view of the missile illustrating a first step in the flight termination process according to an embodiment of the present invention.
Figure 9:
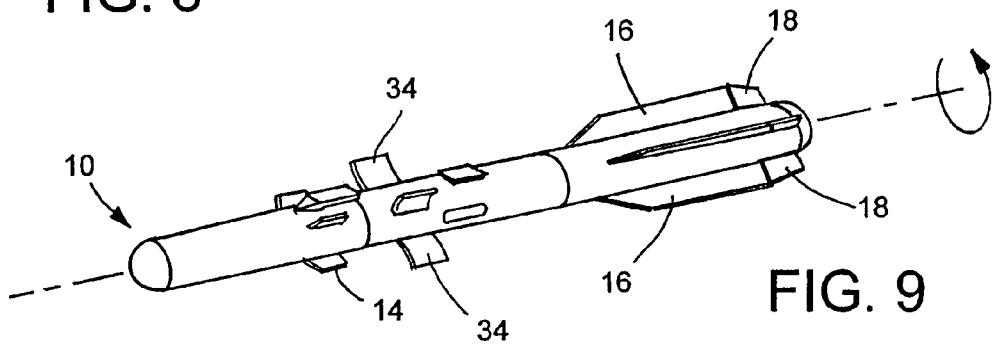
FIG. 9 is a view of the missile illustrating a second step in the flight termination process.
Figure 10:
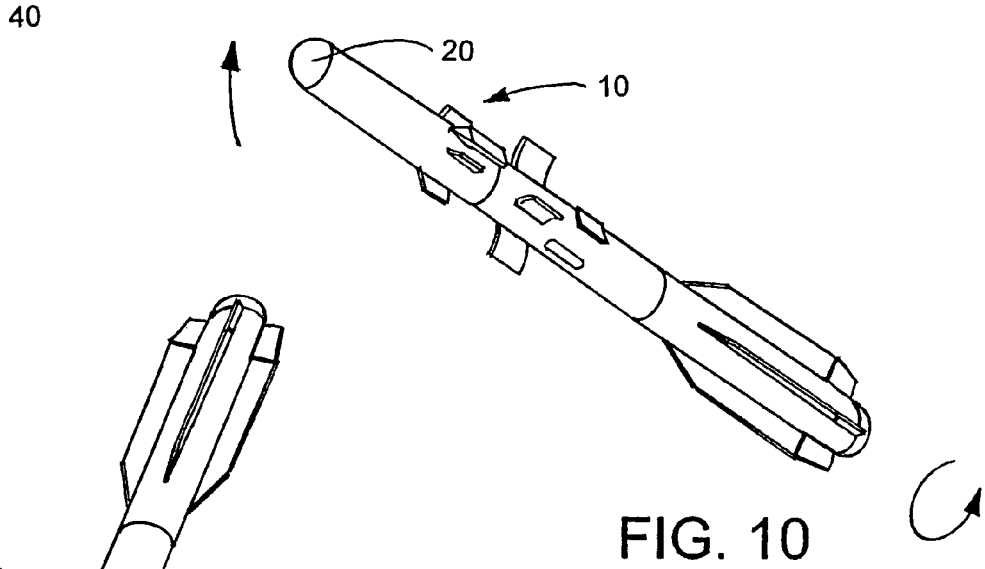
FIG. 10 is a view of the missile illustrating a third step in the flight termination process.
Figure 11:
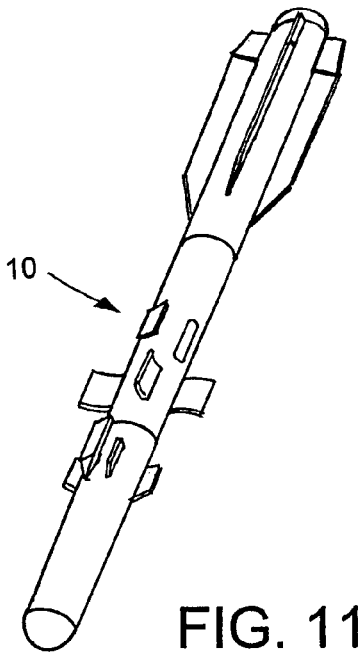
FIG. 11 is a view of the missile illustrating a fourth step in the flight termination process.

FIGS. 8-11 illustrate the process of flight termination of the missile 10. In FIG. 8 the missile 10 is in normal flight, prior to deployment of the lift surfaces 34. FIG. 9 shows the missile 10 just after the deployment of the lift surfaces 34. As discussed earlier, the deployment of the lift surfaces 34 produces a roll moment on the fuselage. With the lift surfaces 34 configured to produce sufficient roll moment to overcome drag in the roll direction (roll damping), such as caused by the presence of the canards 14 and the wings 16 and/or fins 18 on the fuselage 12, the missile 10 begins to rotate about its longitudinal axis 40 at an increasing rate. Eventually the rotation rate approaches the natural roll frequency of the missile 10. The combination of the natural roll frequency and the destabilizing pitching moment from the flight termination deployed wrap-around panels cause increasingly pronounced oscillations in the pitch/yaw planes of the missile 10, as well as aerodynamic pitch angle divergence, as shown in FIG. 10. The pitch-yaw coupling rapidly degenerates into uncontrolled tumbling of the missile 10, illustrated in FIG. 11, leading to an abrupt loss of aerodynamic lift, and crashing of the missile 10.

The following equation has been used to determine the airframe natural frequency:

$$\omega_n = \sqrt{\frac{-Cm_\alpha \cdot q \cdot S_{REF} \cdot L_{REF}}{I_{YY}}}$$

In this equation $\omega_n$ is the natural frequency, $Cm_\alpha$ is the rate of change of pitching moment coefficient due to angle of attack, q is the free-stream air flow dynamic pressure, $S_{REF}$ is the reference area (fuselage cross-sectional area), $L_{REF}$ is a reference length (diameter of the fuselage 12), and $I_{YY}$ is the pitching moment of inertia. When aerodynamic resonance occurs, dynamic cross-coupling effects can cause adverse aerodynamic effects in the form of aerodynamic instability such as erratic Euler angle oscillations and total angle of attack amplification towards divergence. The deployment of the lift surfaces 34 may reduce the magnitude of $Cm_\alpha$, thereby also reducing the magnitude of the airframe natural frequency in rolling $\omega_n$. Thus, the missile pitch/yaw static stability should be slightly negative or nearly neutral once the lift surfaces are deployed. Therefore the proper configuration and deployment of the lift surfaces 34 allows for the roll natural frequency to be reached.

It will be appreciated that the natural roll frequency for an airframe may be determined by any of a variety of suitable methods, such as computational fluid dynamics (CFD) or wind tunnel testing. Wind tunnel testing may be more suitable than computational fluid dynamics, due to the complexity of the flow involved.

The placement of the lift surfaces 34 forward of the center of gravity (center of mass) 22 is an important factor in producing the aerodynamic instability. Prior to the deployment of the lift surfaces 34 the flight of the missile 10 may be stable. Deployment may shift the missile 10 from stable flight to a flight regime that is predominantly unstable. Both the rolling rate and the destabilizing moment produced by the forward-located lift surfaces 34 are fundamental components in producing the tumbling attitude that leads to flight termination. The longitudinal placement of the lift surfaces 34 needs to be located strategically forward of the center of gravity 22, depending on the aerodynamic response of the missile flight termination configuration while in the deployed mode, as learned from the wind tunnel test or computational fluid dynamics (CFD) data results.

Other actions may be taken in conjunction with the deployment of the lift surfaces 34 to produce unstable flight. For example, the autopilot control-panel actuation function may be disabled, in order to inhibit the missile 10 control panels to retain any non-zero hard-over deflection that may impair the intended overall missile flight termination system rolling rate. Another example is venting the motor of the missile 10 in order to eliminate missile thrust. It is stressed that the other actions described in this paragraphs are only examples. The examples are not necessary or essential steps in the flight termination system/method described herein.

The flight termination system 30 advantageously terminates flight quickly, reliably, and inexpensively, without the use of explosives or other hazardous materials. The combination of aerodynamic resonance dynamics and destabilizing pitching moment effects produces aggressive flight termination through rapid Mach number decay, significant loss of flight, high angles of attack, and a tumbling attitude.

Although the invention has been shown and described with respect to a certain preferred embodiment or embodiments, it is obvious that tactical hardware alterations and modifications may occur, implementable by others skilled in the art of aerodynamics upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A missile comprising:

a fuselage; and deployable roll-producing lift surfaces that deploy during flight from the fuselage, forward of a center of gravity of the missile;

wherein the lift surfaces provide a roll moment to the missile, as part of a flight termination system to terminate flight of the missile; and further comprising canards forward of the center of gravity.

2. The missile of claim 1, wherein the lift surfaces also cause the missile to pitch up when the lift surfaces are deployed.

3. The missile of claim 1, wherein the lift surfaces are curved surfaces that substantially conform to the shape of the fuselage, prior to deployment.

4. The missile of claim 1, wherein the lift surfaces are hingedly coupled to the fuselage.

5. The missile of claim 1, further comprising a mechanism for selectively releasing and deploying the lift surfaces.

6. The missile of claim 1, wherein the lift surfaces are deflected (or canted) relative to a longitudinal axis of the fuselage.

7. The missile of claim 6, wherein the lift surfaces are deflected (or canted), relative to the longitudinal axis, at an angle of 0.1 to 1 degrees.

8. The missile of claim 1, further comprising wings and fins aft of the center of gravity.

9. The missile of claim 1, wherein the flight termination system includes the lift surfaces that are located forward of the center of gravity, which cause negative to neutral pitch/yaw static stability while in the deployed position.

10. The missile of claim 1, wherein the canards are forward of the deployable roll-producing lift surfaces.

11. The missile of claim 10, wherein there are at least four of the deployable roll-producing lift surfaces.

12. The missile of claim 1, wherein the lift surfaces are deployed as a group.

13. The missile of claim 6, wherein the lift surfaces are canted, relative to the longitudinal axis, at an angle of 0.2 to 0.3 degrees.

14. The missile of claim 4, wherein the lift surfaces are curved surfaces that substantially conform to the shape of the fuselage, prior to deployment.

15. The missile of claim 14, wherein the lift surfaces are canted relative to a longitudinal axis of the fuselage.

16. The missile of claim 15, wherein the lift surfaces are canted, relative to the longitudinal axis, at an angle of 0.1 to 1 degrees.

17. The missile of claim 15, further comprising canards forward of the center of gravity;

wherein the canards are forward of the deployable roll-producing lift surfaces.

18. The missile of claim 17, further comprising a mechanism for selectively releasing and deploying the lift surfaces.

19. The missile of claim 18, wherein the lift surfaces also cause the missile to pitch up when the lift surfaces are deployed.

* * * * *